US007450098B2

(12) United States Patent
Lee et al.

(10) Patent No.: US 7,450,098 B2
(45) Date of Patent: Nov. 11, 2008

(54) LIQUID CRYSTAL DISPLAY INCLUDING DATA DRIVERS IN MASTER-SLAVE CONFIGURATION AND DRIVING METHOD THEREOF

(75) Inventors: Seung-Woo Lee, Seoul (KR); Young-Ki Kim, Kumi (KR)

(73) Assignee: Samsung Electronics Co., Ltd. (KR)

( * ) Notice: Subject to any disclaimer, the term of this patent is extended or adjusted under 35 U.S.C. 154(b) by 635 days.

(21) Appl. No.: 10/617,026

(22) Filed: Jul. 11, 2003

(65) Prior Publication Data

US 2004/0012553 A1 Jan. 22, 2004

(30) Foreign Application Priority Data

Jul. 19, 2002 (KR) ..... 10-2002-0042656

(51) Int. Cl.
*G09G 3/36* (2006.01)

(52) U.S. Cl. ..... 345/89; 345/99; 345/100; 345/58

(58) Field of Classification Search ..... 345/87, 345/94, 100, 98, 89, 99, 58, 208
See application file for complete search history.

(56) References Cited

U.S. PATENT DOCUMENTS

| | | | | |
|---|---|---|---|---|
| 5,581,273 | A * | 12/1996 | Yoneda et al. | 345/90 |
| 5,945,972 | A * | 8/1999 | Okumura et al. | 345/98 |
| 6,211,851 | B1 * | 4/2001 | Lien et al. | 345/89 |
| 6,483,494 | B1 * | 11/2002 | Liaw et al. | 345/92 |
| 6,873,313 | B2 * | 3/2005 | Washio et al. | 345/100 |
| 2002/0075214 | A1 * | 6/2002 | Kim | 345/88 |
| 2002/0149503 | A1 * | 10/2002 | Lautzenhiser | 341/17 |
| 2003/0038760 | A1 * | 2/2003 | Kim et al. | 345/76 |

FOREIGN PATENT DOCUMENTS

| | | |
|---|---|---|
| JP | 2000-200069 | 7/2000 |
| JP | 200069 | 7/2000 |

* cited by examiner

*Primary Examiner*—Sumati Lefkowitz
*Assistant Examiner*—Seokyun Moon
(74) *Attorney, Agent, or Firm*—MacPherson Kwok Chen & Heid LLP

(57) ABSTRACT

An LCD includes data drivers in a master-slave configuration. The slave data driver includes a capacitor for storing a data voltage applied to a data line in a previous horizontal period by the master data driver and an inverter for inverting polarity of the stored data voltage. The slave data driver applies the inverted data voltage to the data line as a pre-charging voltage.

19 Claims, 2 Drawing Sheets

LIQUID CRYSTAL DISPLAY INCLUDING DATA DRIVERS IN MASTER-SLAVE CONFIGURATION AND DRIVING METHOD THEREOF

CROSS REFERNECE TO RELATED APPLICATION

This application claims the benefit of Korean Patent Application No. 2002-042656 filed in the Korean Intellectual Property Office on Jul. 19, 2002, which is hereby incorporated by reference in its entirety for all purposes as if fully set forth herein.

BACKGROUND OF THE INVENTION (a) Field of the Invention

The present invention relates to a liquid crystal display including a plurality of data drivers in a master-slave configuration and a driving method thereof.

(b) Description of the Related Art

In recent years, light and slim display devices are required as personal computers or television sets become light weight and slim. Since flat panel displays such as liquid crystal displays (LCDs), which satisfy such requirements, are developed and put to practical use in a variety of fields instead of cathode ray tubes (CRTs).

A typical LCD includes a plurality of pixels arranged in a matrix and each pixel includes a liquid crystal (LC) capacitor and a switching element connected thereto. The LC capacitor includes a liquid crystal layer having dielectric anisotropy and two field-generating electrodes for generating electric field in the LC layer. Since LC molecules in the LC layer have orientations depending on the strength of the applied electric field and the transmittance of light incident on the LC layer depends on the molecular orientations, the LCD can display desired images by adjusting the voltages applied to the field generating electrodes. The switching elements selectively transmit data voltages to the LC capacitors and the LCD further includes a plurality of gate lines transmitting gate signals for controlling the switching elements and a plurality of data lines for transmitting the data voltages to the switching elements. The gate signals and the data signals are provided by a gate driver and a data driver, which are controlled by a signal controller.

A dual driving technique, which arranges data drivers at upper and lower sides of the panels, is generally employed for a large, high-resolution LCD. Since each data driver is supplied with image data and control signals for displaying the image data, a pair of printed circuit boards (PCBs) for the provision of the image data and the control signals are required to be placed near the respective data drivers, and this yields the increase of the volume and the manufacturing cost of the LCD.

The data drivers for an LCD connected in a master-slave configuration are suggested for solving the above-described problems. A pair of data drivers in a master-slave configuration have different functions. For example, a slave data driver applies pre-charging voltages to data lines and a master data driver applies expected data voltages to the data lines. In detail, after the slave data driver drives the data lines with a predetermined voltage in a time of a horizontal period, the master data driver drives the data lines with the data voltages in the remaining time of the horizontal period. Accordingly, the slave data driver has a simple configuration for applying a fixed voltage. As a result, the master-slave configuration data drivers do not require a PCB for the slave data driver and further allows the slave data driver to be mounted on the liquid crystal panel in a SOG (silicon on glass) manner.

However, when the difference between a pre-charging voltage and a following data voltage for a pixel is too large to sufficiently charge the pixel to the data voltage for a given time, the image quality of the LCD is deteriorated.

SUMMARY OF THE INVENTION

A liquid crystal display is provided, which includes: a liquid crystal panel assembly including a plurality of gate lines, a data line intersecting the gate lines, and a plurality of pixels connected to the gate lines and the data line; a signal controller receiving image data and a synchronization signal from an external device, processing the image data and generating control signals for displaying the image data; a voltage generator generating a plurality of gray voltages and a gate voltage for driving the panel assembly; a gate driver sequentially scanning the gate lines by applying the gate voltage, each scanning being performed in a horizontal period including a first period and a second period following the first period; a master data driver sequentially applying data voltages selected from the gray voltages corresponding to the image data to the data line, each application is performed in the second period; and a slave data driver storing the data voltage applied to the data line in each second period and applying the stored data voltage to the data line in each first period.

When two data voltages sequentially applied to the data line have opposite polarity with respect to a predetermined voltage, the slave driver preferably inverts the polarity of the stored voltage before application to the data line.

The master driver and the slave driver may be disposed at opposite sides of the panel assembly.

According to an embodiment of the present invention, the slave driver includes a storage and an inverter alternately connected to the data line. The storage stores the data voltages applied to the data line in the second period and the inverter inverts the polarity of the data voltages stored in the storage, Preferably, the storage includes a capacitor, and the inverter includes an operation amplifier in a negative feedback configuration having a non-inverting input terminal supplied with the predetermined voltage.

The slave driver may further include a switch unit selectively connecting the storage and the inverter to the data line, and the switch unit preferably includes a pair of alternately activating first and second switches, the first switch connected between the inverter and the data line while the second switch connected between the storage and the data line.

The slave driver may further include an operational amplifier buffering the data voltage stored in the storage and provides the buffered data voltage for the inverter.

It is preferable that the slave driver is mounted on the panel assembly, and the predetermined voltage is applied to the pixels.

A method of driving a liquid crystal display including first and second gate lines, a data line, a first pixel connected to the first gate line and the data line, and a second pixel connected to the second gate line and the data line is provided, the method includes: scanning the first gate line; applying a first data voltage to the data line during the scanning of the first gate line; storing the first data voltage applied to the data line during the scanning of the first gate line; scanning the second gate line; applying the stored first data voltage to the data line during the scanning of the second gate line; and applying a second data voltage to the data line during the scanning of the second gate line.

Preferably, the method further includes polarity inversion of the stored first data voltage before the application of the stored first data voltage and buffering of the stored data voltage before the polarity inversion.

A liquid crystal display is provided, which includes: first and second pixels; first and second gate lines connected to the first and the second pixels, respectively; a first data line connected to the first and the second pixels; a gate driver scanning the first and the second gate lines in first and second periods, respectively; a master driver applying first and second data voltages to the data line in the first and the second periods, respectively; and a slave data driver storing the first data voltages in the first period and applying the stored first data voltage to the data line in the second period.

When the first and the second data voltages have opposite polarity with respect to a predetermined voltage, the slave driver preferably inverts the polarity of the stored first voltage before application to the data line.

The slave driver preferably includes a storage and an inverter alternately connected to the data line. The storage stores the first data voltage, and the inverter inverts the polarity of the stored first data voltage.

BRIEF DESCRIPTION OF THE DRAWINGS

The above and other advantages of the present invention will become more apparent by describing preferred embodiments thereof in detail with reference to the accompanying drawings in which.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein.

Now, LCDs and driving methods thereof according to embodiments of the present invention will be described in detail with reference to the drawings.

Figure 1:
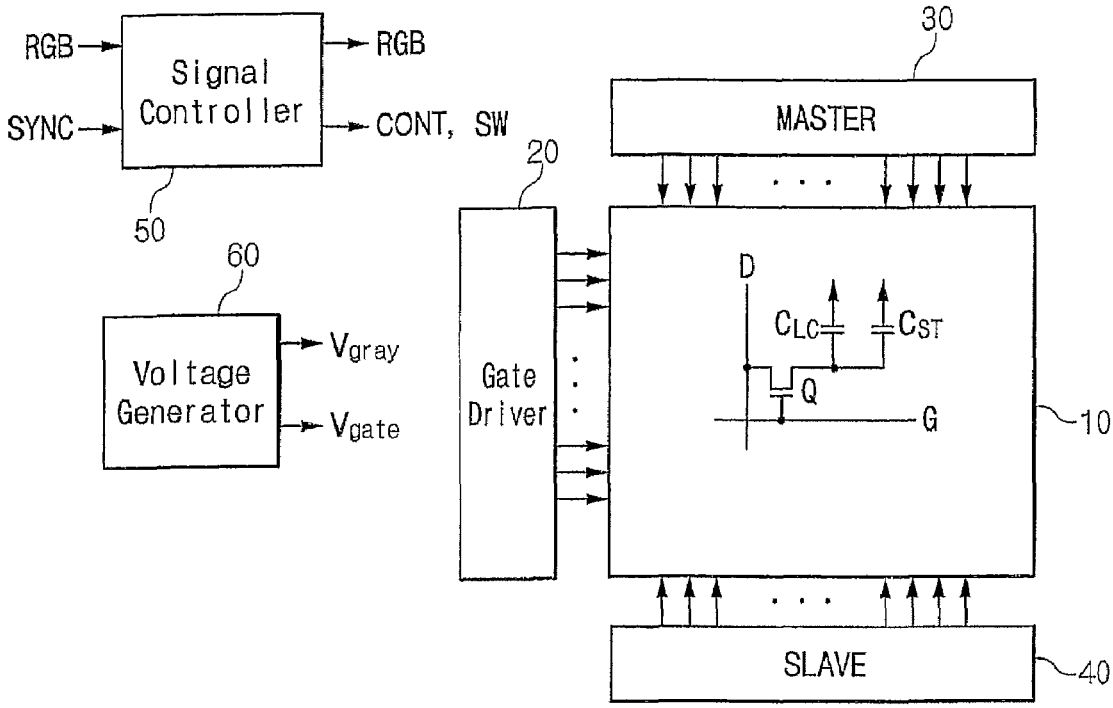
FIG. 1 is a block diagram of an LCD according to an embodiment of the present invention.

FIG. 1 is a block diagram of an LCD according to an embodiment of the present invention.

Referring to FIG. 1, an LCD according to an embodiment of the present invention includes a liquid crystal panel assembly 10, a gate driver 20, a master data driver 30, a slave data driver 40, a signal controller 50, and a voltage generator 60.

The liquid crystal panel assembly 10 includes a plurality of gate lines G, a plurality of data lines D crossing the gate lines G and a plurality of pixels connected to the data lines D and the gate lines G arranged in a matrix. Each pixel includes a thin film transistor (TFT) Q having a gate and a source respectively connected to the gate line G and the data line D, and a pair of an LC capacitor $C_{LC}$ and a storage capacitor $C_{ST}$ connected to a drain of the TFT.

When the gate driver 20 applies a pulsed gate-on voltage to a gate line G to turn on the TFTs Q connected thereto, the slave driver 40 applies a pre-charge voltage to the data lines D, and subsequently, the master driver 30 applies data voltages to the data lines D. These voltages are applied to the LC capacitor $C_{LC}$ and the storage capacitor $C_{ST}$ through the TFT Q, and thereby driving these capacitors $C_{LC}$ and $C_{ST}$ to display desired images.

The signal controller 50 receiving red, green and blue image data RGB and synchronization signals SYNC from an external graphic source, converts data format of the data RGB, and generates and outputs control signals CONT and SW to the gate driver 20 and the master and slave drivers 30 and 40 for driving the panel assembly 10.

The voltage generator 60 generates and outputs a plurality of gray voltages Vgray and gate-on/off voltages Vgate to be applied to the data lines D and the gate lines G. The gray voltages Vgray are transmitted to the master driver 30. The master driver 30 selects the gray voltages Vgray corresponding to the image data from the signal controller 50, and drives the panel assembly 10 with the selected voltages.

The gate driver 20 drives the panel assembly 10 with the gate-on/off voltages Vgate in a manner that it selects the pixels connected to a gate line G every horizontal period by applying the gate-on voltage to the gate line G and the voltage application is performed sequentially for all the gate lines G.

The master driver 30 includes a plurality of data driving ICs (not shown). The master driver 30 sequentially latches the image data from the signal controller 50 to convert data arrangement from a dot at a time scanning into a line at a time scanning. The master driver 30 selects gray voltages equivalent to the respective image data, and then; applies the selected voltages to the respective data lines D on the panel assembly 10 at the same time.

Figure 2:
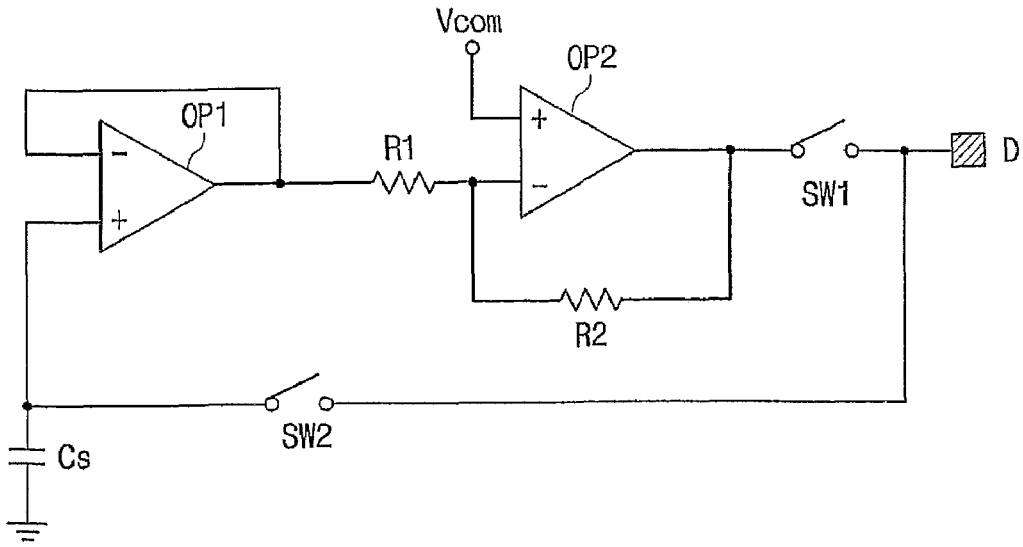
FIG. 2 shows an exemplary driving circuit of a slave data driver according to an embodiment of the present invention.

The slave driver 40 includes a plurality of driving circuits one-to-one corresponding to the data lines D, and an exemplary configuration of a driving circuit is shown in FIG. 2. As described above, the slave driver 40 stores data voltages, which are applied to the data lines D in a previous horizontal period. The slave driver 40 then reverses the polarity of the stored data voltages if required such as when the polarity inversion is employed, and thereafter, the slave driver 40 applies the data voltages to the corresponding data lines D.

Next, a driving circuit of a slave driver for an LCD according to an embodiment of the present invention will be described in detail with reference to FIGS. 2 and 3.

FIG. 2 shows an exemplary driving circuit of the slave driver 40 shown in FIG. 1.

A driving circuit shown in FIG. 2 is connected to each data line D of the liquid crystal panel assembly 10. The driving circuit includes a capacitor Cs, a pair of operation amplifiers OP1 and OP2, and a pair of switches SW1 and SW2.

The capacitor Cs is connected to a ground and stores a data voltage applied to the data line D in a previous horizontal period.

The operation amplifier OP1 in negative feedback configuration has an inverting input terminal (−) and an output terminal connected to each other, and a non-inverting input terminal (+) connected to the capacitor Cs. The amplifier OP1 is an emitter follower serving as a buffer for outputting an input voltage applied to the non-inverting input terminal (+).

The operation amplifier OP2 in negative feedback configuration has an inverting input terminal (−) connected to the output of the amplifier OP1 via an input resistor RI, a non-inverting input terminal (+) connected to a common voltage Vcom, and an output terminal connected to the inverting input terminal (−) via a feedback resistor R2. The amplifier OP2 is an adder for inverting an input voltage applied to the inverting input terminal (−) and adding the inverted input voltage and the common voltage Vcom.

The switch SW1 is connected between the output of the amplifier OP2 and the data line D, while the switch SW2 is connected between the data line D and the capacitor Cs. The switches SW1 and SW2 are alternately activated under the control of the signal controller 50. In detail, the switch SW1 is turned on in a predetermined pre-charging period of a horizontal period, while the switch SW2 is turned on in the remaining period of the horizontal period.

An operation of the driving circuit shown in FIG. 2 is described in detail with reference to FIG. 3, which shows waveforms of the output voltage of the driving circuit and the output voltages of the operation amplifiers OP1 and OP2 as well as waveforms of the control signals for controlling the switches SW1 and SW2.

Figure 3:
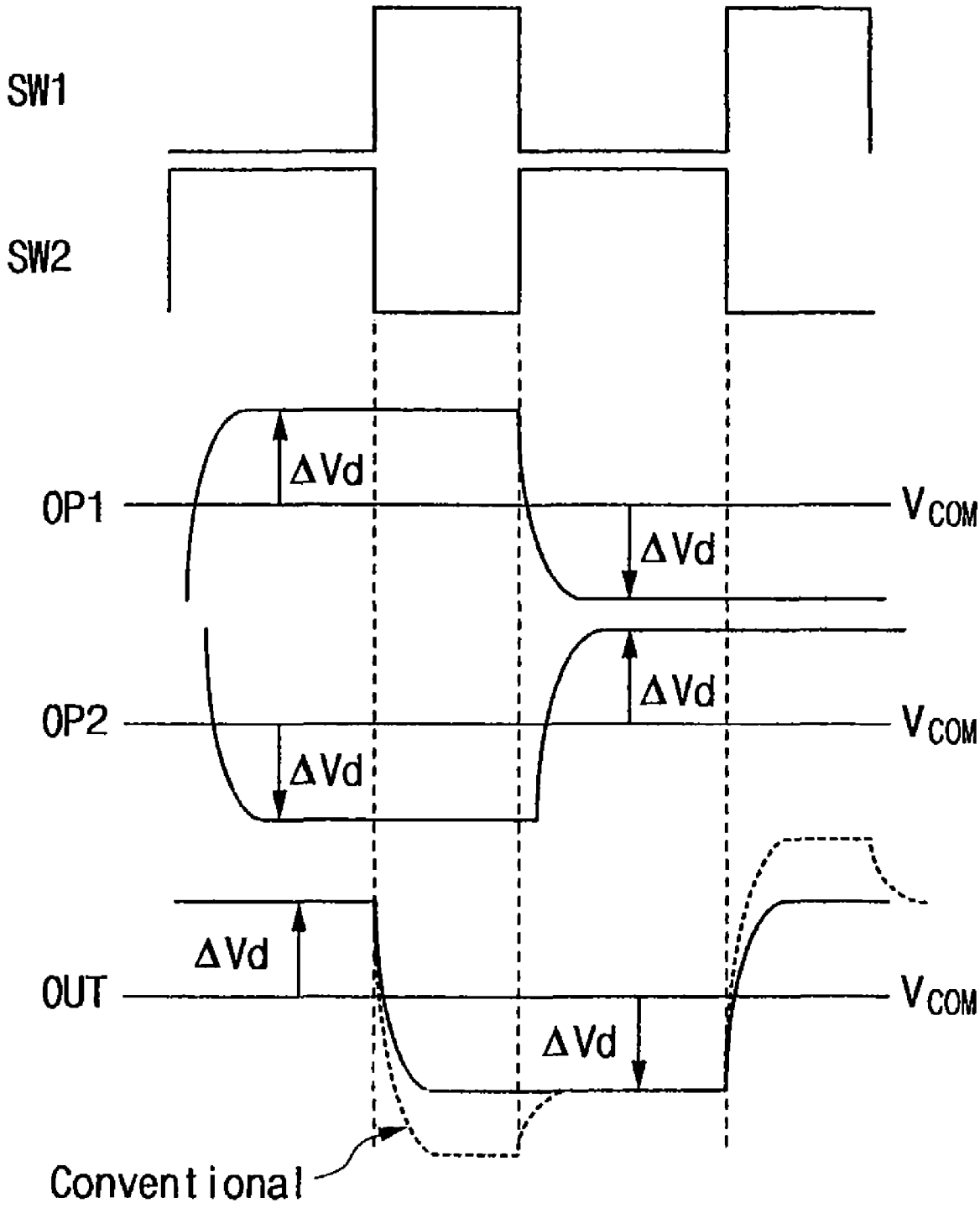
FIG. 3 shows waveforms of signals in the driving circuit shown in FIG. 2.

Referring to FIG. 3, before start of a pre-charging period of a horizontal period, the switch SW1 is in off state and the switch SW2 is in on state. The master driver 30 is applying a data voltage to the data line D. Then, the data voltage is also applied to the capacitor Cs via the switch SW2 to be charged into the capacitor Cs. The charged voltage ΔVd is maintained by the amplifier OP1 and reversed with respect to the common voltage Vcom by the amplifier OP2. The reason why the common voltage Vcom is applied to the operational amplifier OP2 is that the common voltage Vcom is the reference of the polarity inversion.

Upon the beginning of a horizontal period and of a pre-charging period of the horizontal period, the switch SW1 is turned on and the switch SW2 is turned off. The output voltage of the amplifier OP2 is applied to the data line D through the switch SW1. That is, the driving circuit applies the voltage, which is applied to the data line D in the previous horizontal period, to the data line D as a pre-charging voltage of a current horizontal period.

When the pre-charging period is completed, the switch SW1 is turned off and the switch SW2 is turned on. Then, a data voltage for this horizontal period supplied by the master driver 30 begins to be charged in the capacitor Cs.

Because the data voltages applied to two adjacent pixels usually have similar absolute values with respect to the common voltage Vcom, the data voltage for a pixel and the pre-charging voltage therefor, which is the data voltage applied to an adjacent pixel according to this embodiment, have nearly the same magnitude. Accordingly, the data drivers in a master-slave configuration according to this embodiment sufficiently charge all the pixels with corresponding data voltages.

In addition, since the driving circuit for the slave driver according to this embodiment has a simple configuration, thereby facilitating its design and enlarging a process margin.

While the present invention has been described in detail with reference to the preferred embodiments, it is to be understood that the invention is not limited to the disclosed embodiments, but, on the contrary, is intended to cover various modifications and equivalent arrangements included within the sprit and scope of the appended claims.

What is claimed is:

1. A liquid crystal display comprising:

a liquid crystal panel assembly including a plurality of gate lines, a data line intersecting the gate lines, and a plurality of pixels connected to the gate lines and the data line;

a signal controller configured to receive image data and a synchronization signal from an external device, process the image data and generate control signals for displaying the image data;

a voltage generator configured to generate a plurality of gray voltages and a gate voltage for driving the panel assembly;

a gate driver configured to sequentially scan the gate lines by applying the gate voltage, each scanning being performed in a horizontal period including a first sub-period and a second sub-period following the first sub-period;

a master data driver configured to sequentially apply to the data line one of the data voltages selected from the gray voltages corresponding to the image data, wherein each application is performed in the second sub-period of a present horizontal period; and a slave data driver configured to store the data voltage applied to the data line in the second sub-period of the present horizontal period and apply the stored data voltage to the data line in the first sub-period of a next horizontal period.

2. The liquid crystal display of claim 1, wherein two data voltages sequentially applied to the data line have opposite polarity with respect to a predetermined voltage and the slave driver inverts the polarity of the stored voltage before application to the data line.

3. The liquid crystal display of claim 2, wherein the master driver and the slave driver are disposed at opposite sides of the panel assembly.

4. The liquid crystal display of claim 2, wherein the slave driver comprises:

a storage for storing the data voltages applied to the data line in the second sub-period; and an inverter for inverting the polarity of the data voltages stored in the storage, the storage and the inverter alternately connected to the data line.

5. The liquid crystal display of claim 4, wherein the storage comprises a capacitor.

6. The liquid crystal display of claim 4, wherein the inverter comprises an operation amplifier in a negative feedback configuration having a non-inverting input terminal supplied with the predetermined voltage.

7. The liquid crystal display of claim 4, wherein the slave driver further comprises a switch unit selectively connecting the storage and the inverter to the data line.

8. The liquid crystal display of claim 7, wherein the switch unit comprises a first switch connected between the inverter and the data line and a second switch connected between the storage and the data line, the first switch and the second switch alternately activated.

9. The liquid crystal display of claim 4, wherein the slave driver further comprises an operational amplifier buffering the data voltage stored in the storage and provides the buffered data voltage for the inverter.

10. The liquid crystal display of claim 4, wherein the slave driver is formed on the panel assembly.

11. The liquid crystal display of claim 2, wherein the predetermined voltage is applied to the pixels.

12. A method of driving a liquid crystal display including first and second gate lines, a data line, a first pixel connected to the first gate line and the data line, and a second pixel connected to the second gate line and the data line, the method comprising:

scanning the first gate line;

applying a first data voltage to the data line during the scanning of the first gate line;

receiving the first data voltage from the data line and storing in a capacitor the first data voltage during the scanning of the first gate line;

scanning the second gate line during a horizontal period comprising a first sub-period and a second sub-period;

applying the stored first data voltage from a slave data driver to the data line during the first sub-period of the scanning of the second gate line; and applying a second data voltage to the data line during the second sub-period of the scanning of the second gate line.

13. The method of claim 12, further comprising:

inverting polarity of the stored first data voltage before the application of the stored first data voltage.

14. The method of claim 13, further comprising:

buffering the stored data voltage before the polarity inversion.

15. A liquid crystal display comprising:

first and second pixels;

first and second gate lines connected to the first and the second pixels, respectively;

a first data line connected to the first and the second pixels;

a gate driver configured to scan the first gate line in a first horizontal period and scan the second gate line in a second horizontal period, each horizontal period including a first sub-period and a second sub-period following the first sub-period;

a master driver configured to apply a first data voltage to the data line in the first horizontal period and a second data voltage to the data line in the second horizontal period, wherein each application is performed in the second sub-period of each horizontal period; and a slave data driver configured to store the first data voltage applied to the data line in the second sub-period of the first horizontal period and to apply the stored first data voltage to the data line in the first sub-period of the second horizontal period.

16. The liquid, crystal display of claim 15, wherein the first and the second data voltages have opposite polarity with respect to a predetermined voltage and the slave driver inverts the polarity of the stored first voltage before application to the data line.

17. The liquid crystal display of claim 16, wherein the slave driver comprises:

a storage for storing the first data voltage; and an inverter for inverting the polarity of the stored first data voltage, the storage and the inverter are alternately connected to the data line.

18. The liquid crystal display of claim 17, wherein the slave driver further comprises a switch unit selectively connecting the storage and the inverter to the data line.

19. The liquid crystal display of claim 18, wherein the switch unit comprises a first switch connected between the inverter and the data line and a second switch connected between the storage and the data line, the first switch and the second switch alternately activated.

* * * * *